United States Patent [19]

Graff

[11] Patent Number: 4,867,401

[45] Date of Patent: Sep. 19, 1989

[54] BAG HOLDER

[76] Inventor: Frederick E. Graff, 2264 Hollow Park Ct., Thousand Oaks, Calif. 91360

[21] Appl. No.: 228,039

[22] Filed: Aug. 4, 1988

[51] Int. Cl.[4] ..... F16M 13/00

[52] U.S. Cl. ..... 248/99; 294/1.1

[58] Field of Search ..... 248/99, 100, 97, 95; 294/1.1

[56] References Cited

U.S. PATENT DOCUMENTS

| | | | |
|---|---|---|---|
| 1,669,744 | 5/1928 | Espensen | 294/1.1 |
| 2,401,969 | 6/1946 | Schlank | 248/100 X |
| 2,636,656 | 4/1953 | Tanabe | 248/100 X |
| 2,789,781 | 4/1957 | Miller | 248/100 |
| 4,269,441 | 5/1981 | Hirsch | 294/1.1 |
| 4,440,430 | 4/1984 | Kruse | 248/95 X |
| 4,638,968 | 1/1987 | Auten | 248/100 X |

FOREIGN PATENT DOCUMENTS

| | | | |
|---|---|---|---|
| 224528 | 7/1943 | Switzerland | 248/99 |

*Primary Examiner*—Ramon S. Britts
*Assistant Examiner*—Karen J. Chotkowski
*Attorney, Agent, or Firm*—Jack C. Munro

[57] ABSTRACT

A round, ring-shaped, tubular frame which is to be located within the mouth of a thin walled, flexible bag. The frame includes a pair of handles located in a spaced apart arrangement with these handles being of a cross-sectional configuration larger than the frame. Mounted on each handle is a protuberance with this protuberance to penetrate the wall of the bag for securing the attachment of the bag onto the frame.

4 Claims, 1 Drawing Sheet

BAG HOLDER

BACKGROUND OF THE INVENTION

The field of this invention relates to trash collecting devices and more particularly to a tubular frame which facilitates the usage of a flexible walled trash bag.

Depositing of a large quantity of trash within a flexible walled trash bag is rather a cumbersome procedure for one person. Generally, this requires that the user use both hands to pick up the trash and place the trash within the bag. The bag has a natural tendency to close. Therefore, the individual is constantly trying to keep the trash bag open and at the same time deposit trash within the bag. This problem is especially accentuated when using a trash bag to pick up yard debris, such as grass clippings, leaves, plant trimmings, etc.

Previously, there have been attempts in utilizing some form of device to keep a trash bag open. However, these previously known devices have been substantially complex and comprise an upright frame which may or may not include wheels within which there is to be mounted the trash bag in an upright position in an open state. These previously known devices are relatively expensive to manufacture and not intended to be inexpensive to manufacture and, therefore, inexpensive to purchase.

SUMMARY OF THE INVENTION

The structure of the present invention is directed to a tubular, ring-shaped frame which defines a ring diameter very similar to the size of the open mouth of a thin walled, flexible trash bag. This ring-shaped member has mounted thereon a pair of enlarged cross-sectional areas which are formed into handles with these handles being located substantially diametrically apart relative to the ring-shaped member. These handles increase the strength of the ring-shaped member to maintain the ring-shaped member in the ring configuration. The flexible walled trash bag is to be draped over the ring member with therebeing a protuberance mounted in conjunction with each handle which is to penetrate the wall surface of the bag to thereby secure attachment of the bag onto the member. A portion of the ring member between the handles can be pressed against the ground or other similar type of supporting surface and is flexible enough to assume a substantially flattened configuration so as to facilitate the raking or otherwise directly moving of trash along the ground into the trash bag.

The primary objective of the present invention is to construct a trash collecting apparatus which supports a flexible walled trash bag to facilitate depositing of the trash therein. Further, the trash bag is to be used in an upright (vertical) position or is used in a horizontal position with the trash being raked or otherwise moved along the ground directly into the bag.

Another objective of the present invention is to construct a bag holder which is manufactured of relatively few parts and can be manufactured inexpensively and therefore sold to the ultimate consumer at an inexpensive price.

DETAILED DESCRIPTION OF THE SHOWN EMBODIMENT

Figure 1:
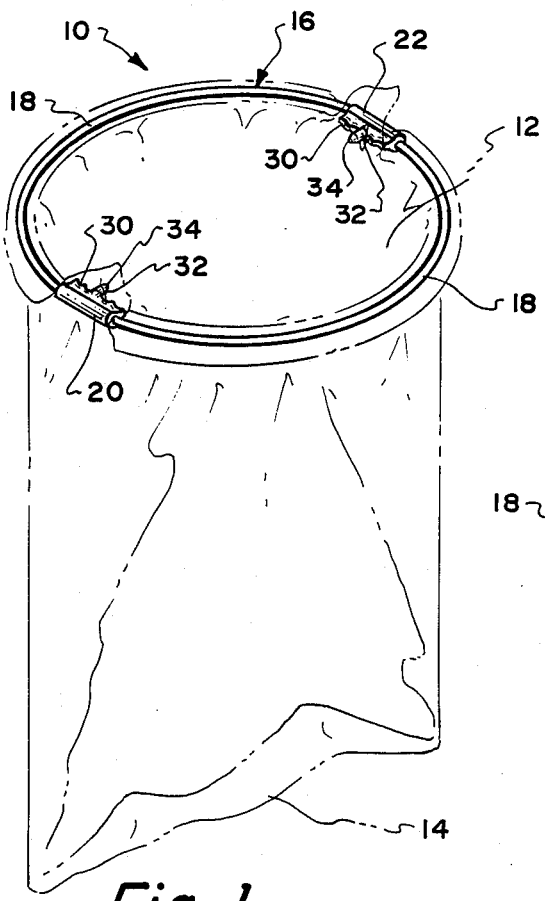
FIG. 1 is a view showing the bag holder of the present invention mounted in conjunction with a flexible walled bag with the bag in an open position.

Referring particularly to the drawing, there is shown the bag holder 10 of this invention which is designed to be located at the mouth 12 of a flexible walled plastic bag 14. Bag holder 10 defines a ring-shaped member 16 which is constructed of a plurality of tubular segments 18. These segments 18 are to be constructed of a plastic material, generally a propylene or polystyrene being preferable. It is important that the segments 18 have a certain amount of flexibility. This flexibility is sufficient when, if the segment 18 is pressed against a hard supportive surface such as the ground, a portion of the segment 18 will flatten. This flat area can be used to facilitate entry of trash from the ground into the bag 14.

Connecting together the segments 18 are a pair of handle members 20 and 22. These handle members 20 and 22 are identical to each other. The handle members 20 and 22 are located substantially diametrically opposite each other relative to the ring-shaped member 16. The ends of the tubular segments 18 are mounted within bores 24 and 26 of the handle members 20 and 22. If such is desired, segments 18 may be fixedly secured within the bores 24 and 26. However, normally, free pivoting of the handle members 20 and 22 relative to the ring-shaped member 16 will be permitted. The reason for this pivoting will be explained further on in this specification.

As is apparent from the drawing, the ring-shaped member 16 has a single longitudinal center axis. Each handle member 20 and 22 also has a longitudinal center axis which coincides with the single longitudinal center axis of the ring-shaped member 16.

Each of the segments 18 may include indicia in the form of a series of score lines 28 located directly adjacent each end of each segment 18. It is the function of the score lines 28 to denote portions of the segment 18 that could be removed in order to decrease the diameter of the ring-shaped member 16. The reason that the diameter of the ring-shaped member 16 would want to be decreased is so to provide for adjustability to accommodate to smaller sized bags 14.

Each handle member 20 and 22 includes finger accommodating recesses 30. Also, in the area of the recesses 30 is a protuberance 32. The protuberance 32 includes a sharpened outer point 34.

Figure 3:
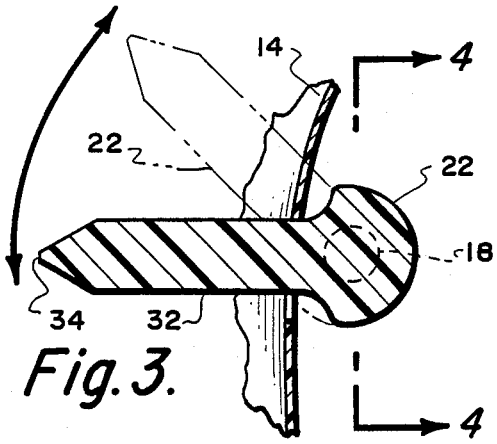
FIG. 3 is a cross-sectional view taken through one of the handle members of the bag holder of the present invention taken along line 3—3 of FIG. 2 showing the handle member being mounted in conjunction with the bag.
Figure 4:
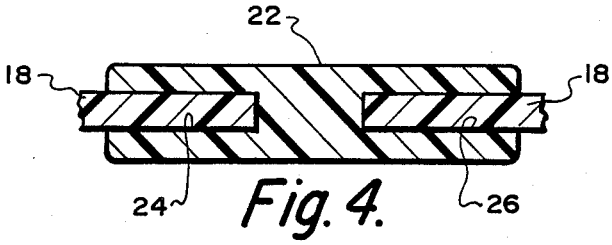
FIG. 4 is a cross-sectional view through one of the handle members of the present invention taken along line 4—4 of FIG. 3.
Figure 2:
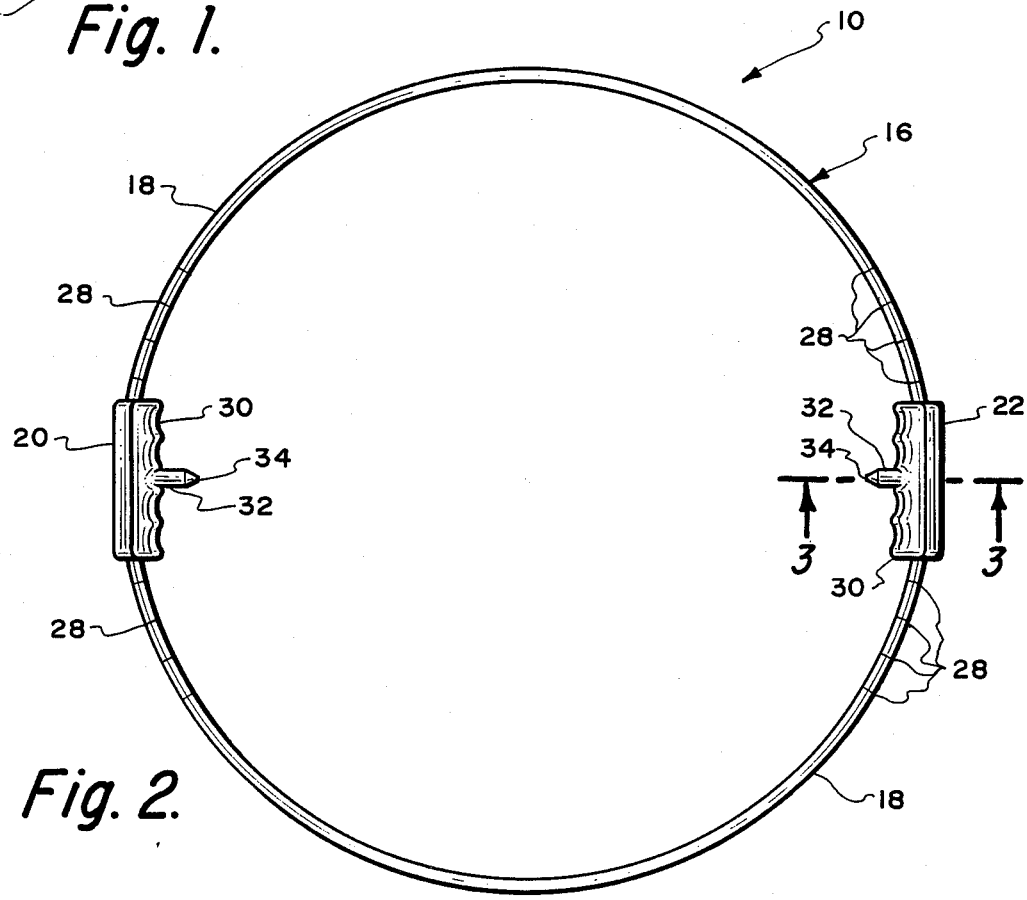
FIG. 2 is a top plan view of the bag holder of the present invention showing such disconnected from the bag.

The bag holder 10 of the present invention is to be utilized as follows: The mouth 12 area of the bag 14 is to be placed within the confines of the ring-shaped member 16. The mouth 12 area of the bag 14 is then draped over the ring-shaped member 16 in an overlapping manner with the wall surface of the bag 14 being caused to be penetrated by the protuberances 32. This penetration of the wall of the bag 14 functions to secure the mounting of the bag 14 onto the ring-shaped member 16. This penetration by the protuberances 32 can be with the protuberances 32 pointing in a direction substantially perpendicular to the plane of the ring-shaped member 16. After the wall of the bag 14 has been penetrated, the operator can then pivot the handle members 20 and 22 to the position as shown in FIGS. 1 and 2 of the drawing which would be from the dotted line position shown in FIG. 3 to the solid line position. As is apparent within FIG. 4, the pivot axis of the handle members 20 and 22 coincides with the longitudinal center axis of the ring-shaped member 16. As a result, the bag 14 is further tightened onto the ring-shaped member 16 thereby substantially eliminating any possibility of the bag 14 becoming accidentally disengaged from the ring-shaped member 16 during its usage. At this time, bag holder 10 can be used to continuously hold the bag 14 in an open configuration so as to facilitate the depositing of trash therein.

What is claimed is:

1. In combination with a thin walled, flexible bag having an internal enclosing chamber adapted to contain trash, said bag having a mouth providing access into said internal enclosing chamber, a device for holding open said mouth to facilitate the entry of trash into said internal enclosing chamber, said device comprising:

a ring-shaped member, said ring-shaped member to be mounted within said mouth with the portion of said bag at said mouth being draped over said ring-shaped member, said ring-shaped member being tubular having a first longitudinal center axis coplanar with and tangential to said ring-shaped member;

handle means mounted on said ring-shaped member for grasping by the user facilitating manual movement usage of said bag, said handle means having a second longitudinal center axis, said second longitudinal center axis coinciding with said first longitudinal center axis, said handle means comprising two separate tubular handle members being located substantially diametrically apart on said ring-shaped member; and bag securing means attached to each said handle member, said bag securing means to connect with said bag for securing the position of said bag onto said ring-shaped member, said bag securing means comprising an outwardly extending protuberance with there being a said protuberance for each said handle member, each said protuberance including a means for penetrating the wall of said bag forming a hole within the bag.

2. The combination as defined in claim 1 wherein:

said handle members being identical in shape, said handle members being larger in cross-sectional configuration than said ring-shaped member.

3. The combination as defined in claim 1 wherein:

a pivot means adjoining each said handle member to said ring-shaped member, with said bag mounted on each said protuberance, said handle members are to be individually pivoted to tighten the securement of said bag on said ring-shaped member.

4. The combination as defined in claim 1 wherein:

said ring-shaped member being constructed of a rigid but deflectable material thereby being deformable to assume a substantially flattened configuration when manually pressed against the supportive surface such as the ground.

* * * * *

UNITED STATES PATENT AND TRADEMARK OFFICE

CERTIFICATE OF CORRECTION

PATENT NO. : 4,867,401

DATED : Sep. 19, 1989

INVENTOR(S) : Frederick E. Graef

It is certified that error appears in the above—identified patent and that said Letters Patent is hereby corrected as shown below:

Title page:

The line under United States Patent [19], delete "Graff" and insert ---Graef---.

Line [76] the last name of the inventor is misspelled, delete "Graff" and insert ---Graef---.

Signed and Sealed this

Thirty-first Day of July, 1990

*Attest:*

HARRY F. MANBECK, JR.

*Attesting Officer*

*Commissioner of Patents and Trademarks*